United States Patent [19]

Niebel

[11] Patent Number: 5,071,270

[45] Date of Patent: Dec. 10, 1991

[54] DOT MATRIX PRINT HEAD WITH MOVEABLY ADJUSTABLE NEEDLE GUIDE

[75] Inventor: Harald Niebel, Senden, Fed. Rep. of Germany

[73] Assignee: Mannesmann A.G., Düsseldorf, Fed. Rep. of Germany

[21] Appl. No.: 587,177

[22] Filed: Sep. 20, 1990

Related U.S. Application Data

[63] Continuation of Ser. No. 716,147, Mar. 26, 1985, abandoned.

[30] Foreign Application Priority Data

Apr. 3, 1984 [DE] Fed. Rep. of Germany ..... 3412854

[51] Int. Cl.[5] ..... B41J 2/265

[52] U.S. Cl. ..... 400/124; 101/93.05

[58] Field of Search ..... 400/124, 124 VI; 101/93.05

[56] References Cited

U.S. PATENT DOCUMENTS 4,459,051 7/1984 Kawai ..... 400/124
4,640,633 2/1987 Hebert ..... 400/124

FOREIGN PATENT DOCUMENTS 52066 5/1982 European Pat. Off. ..... 400/124
62165 5/1981 Japan ..... 400/124

*Primary Examiner*—David A. Wiecking
*Attorney, Agent, or Firm*—R. H. Siegemund

[57] ABSTRACT

A dot matrix print head with a moveable print needle guide. The dot matrix print head includes an elastic adjustment element mounted in the housing of the dot matrix print head and extending at least approximately parallel to the print needles. The movement of the guide relative to the housing is adjustable.

5 Claims, 1 Drawing Sheet

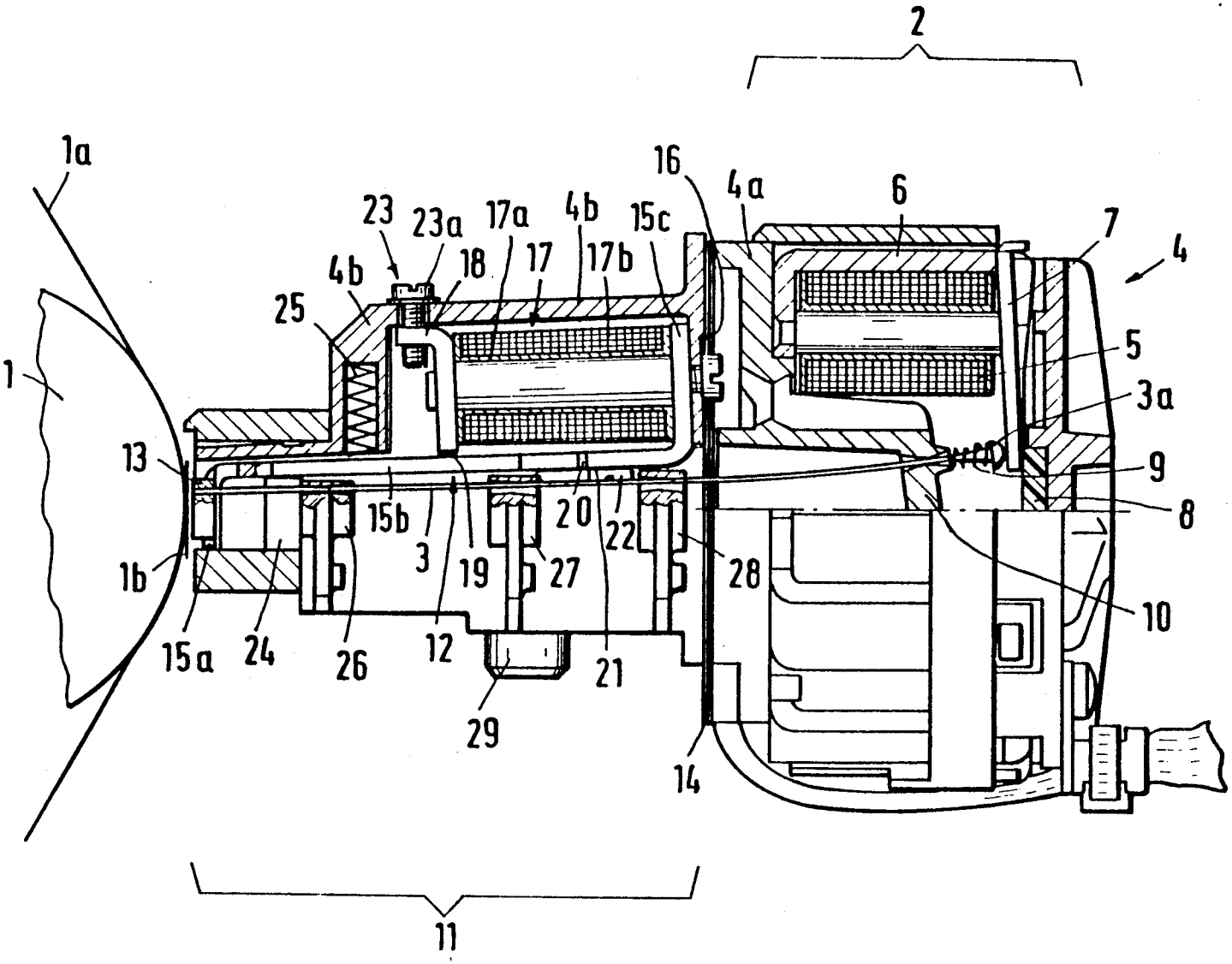
2
4
7
5
3a
9
8
10
6
4a
16
15c
17b
4b
17
17a
18
23a
23
4b
25
28
14
22
21
20
27
29
19
12
3
15b
26
24
15a
13
1b
1a
1
11

DOT MATRIX PRINT HEAD WITH MOVEABLY ADJUSTABLE NEEDLE GUIDE

This is a continuation of co-pending application Ser. No. 06/716,147 filed on Mar. 26, 1985, now abandoned.

FIELD OF THE INVENTION

The invention relates to a dot matrix print head with an adjustable print needle guide. The print needle adjustment unit, with the print needle adjustment drive and the guide orifice fastened to an elastic adjustment element, is placed between the print countersupport and the print needle drive unit.

BACKGROUND OF THE INVENTION

Dot matrix print heads with adjustable print needle guides are used for high-speed printing and/or calligraphy. In high-speed printing, the printing is accomplished with unchanged position of the print needle guide in successive lines from left to right or from right to left. In calligraphy (specifically, in relatively high-speed calligraphy), the printing is accomplished by going over the same line twice in printing passes going in the same or opposite directions and by adjustment of the print needle guide. In this connection, the needle column consists, e.g., of seven to nine needles and can thus be in one column. Of course it is possible, if the structurally available space in the dot matrix print head permits such a design, to provide several needle columns lying next to one another, each with seven to nine print needles placed over one another.

A dot matrix print head with an adjustable needle guide is known from German Published Patent Document DE-OS 26 32 293. In the device disclosed in that document, the print head has print wires placed equidistant in two columns, and the print wire columns are movable in relation to one another in the vertical direction. The print wires of the columns in each case are placed on a support element. One of the support elements is fixedly mounted on the print head carriage, and the other support element is held by a leaf spring at the upper end. The second support element is vertically movable by a cam that can be actuated electromagnetically or manually.

It is further known from German Published Patent Document DE-OS 30 41 877 to make the adjustment element of the dot matrix print head from a lever which is produced from an elastic material and is mounted to swivel around an axis. Such an adjustment element requires, as has been shown, a precise determination of the end positions and a design which results in a flat print head in the area of the print countersupport in order to make a better inspection of the printing process possible. Moreover, an economical production of the part should be assured, also including easy installation. Additionally, as already explained, a special problem is posed by the end positions of the guide orifice, which must be kept very exact because of the desired printing precision for calligraphy.

OBJECT OF THE INVENTION

Therefore, the principle object of the invention is to provide a dot matrix print head permitting precise adjustment of the guide orifice with easily controllable production tolerances.

A further object of the invention is to provide a dot matrix print head having a flat design in the area of the guide orifice.

Yet a further object of the invention is to provide a dot matrix print head which is simple to install and the parts of which are easily adjustable.

SUMMARY OF THE INVENTION

The foregoing objects are achieved by the provision of an adjustment element which runs approximately parallel to the print needles in the area of the print needles and is in contact with the magnet core of an electromagnet that is approximately parallel to the adjustment element. An armature bridge, connected to the magnet core, forms an air gap with the adjustment element.

This invention makes it possible to provide a precise adjustment for the guide orifice, easily to control the production tolerances of the parts, and to achieve a flat design in the area of the guide orifices despite the required electromagnet. Furthermore, this invention makes possible a simple installation, whereby a reliable adjustment of the end positions of the adjustment element is made possible. Further, an adequate adjustability of the parts important for functioning is provided.

The adjustment element consists of a lever made in two parts. The two lever parts are flexibly connected by a leaf spring for a movement in the vertical plane. This design improves the elastic quality of the known adjustment element in that each lever part can be rigid in itself, whereby the spring action is produced substantially only by the leaf spring. Therefore, with this solution a precise movement of the adjustment element is possible, whereby the swiveling movement of the adjustment element is performed with a relatively small radius. Such a precise adjustment movement acts in the sense of a very largely vertical position in the vertical plane in front of the print countersupport.

A practical embodiment for the accommodation of the parts is advantageous in that the electromagnet and armature bridge are placed over the adjustment element.

The adjustability is further promoted by the armature bridge being made adjustable on the magnet core of the electromagnet. This measure allows adjustment work to be performed on the dot matrix print head during or after installation and even during operation.

In this connection, it is advantageous that an adjustment means be provided which can be operated from the outside of the print head housing for adjustment of the armature bridge. This measure provides access to the adjustment means by service personnel.

The precision of the dot matrix print head according to the invention is further increased by the provision of a solid stop for one end position of the adjustment element. The adjustment element is spring-loaded in the direction of the stop. My copending patent application of common assignee, Ser. No. 696,009, filed 01/29/1985 is incorporated by reference particularly but not extensively as to all common subject matter.

BRIEF DESCRIPTION OF THE DRAWING

The single figure shows an axially longitudinal section through the presently preferred embodiment of the dot matrix print head.

DETAILED DESCRIPTION OF THE PRESENTLY PREFERRED EMBODIMENT

A dot matrix print head with a print needle guide which is adjustable in the printing position is opposite a print countersupport, or platen, 1. A record carrier 1*a* and a printing ribbon 1*b* pass between the dot matrix print head and the print countersupport 1. A print needle drive unit 2 with all the parts necessary for firing individual needles 3 is not described in detail, because the usual components (e.g., electromagnetic coils 5, yoke body 6, hinged armature 7, stop 8, print needle guide 3*a*, return spring 9, and rear print needle bearing 10) are contained in a separate housing 4*a* of the print head 4 for the functioning of the printer. These elements are only indirectly related to the invention, and they optionally could be chosen in another configuration.

A print needle adjustment unit 11 includes an adjustment element 12 on which a guide orifice 13 is fastened. The print needle adjustment unit 11 is in a separate housing 4*b* of the print head housing 4. The housing 4*b* of the print needle adjustment unit 11 and the housing 4*a* of the print head 4 are connected by the insertion of spacers 14. The print needle adjustment unit 11 in turn is mounted with fixing guide pins 29 on the dot matrix printer carriage (not shown), which is moved back and forth in front of record carrier 1*a*.

Adjustment element 12 consists of an elastic lever composed of lever sections 15*a*, 15*b*, and 15*c*. Guide orifice 13, with a ruby orifice for print needles 3, is fastened to distal lever section 15*a*. Intermediate lever section 15*b* runs almost parallel to print needles 3. Proximal lever section 15*c* is connected to housing 4*b* by a screw 16. The screw 16 goes through proximal lever section 15*c* and also holds a magnet core 17*a* with winding 17*b* of an electromagnet 17. An armature bridge 18 is mounted on the magnet core 17*a* opposite the proximal lever section 15*c*. The armature bridge 18 and the intermediate lever section 15*b* form an air gap 19.

The lever sections 15*a*, 15*b*, and 15*c* can individually consist of relatively rigid material. The travel of guide orifice 13 (corresponding to air gap 19) is within the limits of 0.01 to 1 mm for the changeover from high-speed printing to calligraphy. An average travel is about 0.15 mm.

As shown in the drawing, the intermediate lever section 15*b* can consist of two parts. In this is especially advantageous design, the intermediate lever section 15*b* contains a gap 20 which is spanned by a leaf spring 21, so that a play-free joint is produced for the travel of the intermediate lever section 15*b* in the vertical plane. The leaf spring 21 is fastened by spot welding to one part of intermediate lever section 15*b* and by screws 22 to the other part of intermediate lever section 15*b*.

Armature bridge 18 is adjusted by adjustment means 23 which includes a threaded screw 23*a* which is accessible on housing 4*b* to adjust the size of air gap 19.

Adjustment element 12 is adjustable between end positions that limit the vertical travel of the intermediate lever section 15*b*. The lower end position is defined by contact with the solid stop 24. A spring 25 presses the intermediate lever section 15*b* against the stop 24. The upper end position of the intermediate lever section 15*b* is defined by contact with the armature bridge 18. Solid stop 24 is designed so that adjustment element 12 does not by chance come in contact with print wire guides 26, 27, and 28.

What is claimed as new and desired to be secured by Letters Patent of the United States is:

1. Matrix printhead having a case, a plurality of print styli drives in the case, a plurality of print styli extending in the case and from the respective drives therein, towards a mouthpiece at an end of the case such that ends of the styli are positioned adjacent a printing platen, the printhead being provided for movement along said platen; said mouthpiece being movable within said case transversely to the extension of the styli; a magnetizable coil/core arrangement having an axis between a first end and a second end such that the coil of said arrangement loops around the axis, opposite magnetic poles develop at the oppositely situated first and second ends of coil/core arrangement, said arrangement being mounted in the case so that the said axis extends along said styli and essentially parallel to said styli, the improvement comprising:

further including an L-shaped lever having one portion secured to the first end of the core and having a second portion extending alongside the coil/core arrangement;

an armature bridge movably and adjustably fastened to the case for adjustment in a direction transverse to the extension of the coil/core arrangement, and being in magnetically conductive abutment with the second end of the core;

a lever arm carrying said mouthpiece and extending also along said coil/core arrangement and in magnetic relation to said bridge to establish therewith an air gap, the lever arm being attracted to said armature bridge on energization of the coil; and a leaf spring connecting the lever arm to the second portion of the L-shaped lever so that the lever arm can pivot relative to the L-shaped lever.

2. A dot matrix print head as in claim 1, wherein:

the dot matrix print head further comprises a stop mounted in said housing to limit movement of said lever arm in one direction and including spring means for biasing said lever arm in the direction of said stop.

3. A dot matrix print head as in claim 1, wherein said armature bridge is adjustable relative to said magnetic core by adjusting means being accessible from outside said housing.

4. Matrix printhead, having a case containing a plurality of print styli drives, there being a plurality of print styli extending in said case and from the respective drives therein, towards a mouthpiece at an end of the case to be positioned adjacent a printing platen, the head being provided for movement along the platen; said mouthpiece being movable within said case and in a direction transverse to an extension of the styli; a print styli and mouthpiece adjusting device including an electromagnetic drive, said drive including a magnetic coil wound around a core to establish a coil/core configuration, said configuration having a longitudinal axis around which the coil extends, opposite magnetic poles developing at a first and second end, said poles being oppositely located on and being spaced along said axis, said axis extending along said print styli but being laterally offset with respect to said print styli, the improvement comprising said drive further including an L-shaped lever having one portion secured to the first end of the core and having a second portion extending alongside the coil/core arrangement;

an armature bridge movably and adjustably fastened to the case for adjustment in a direction transverse to the extension of the coil/core arrangement, and being in magnetically conductive abutment with the second end of the core;

a lever arm carrying said mouthpiece and extending also along said coil/core arrangement and in magnetic relation to said bridge to establish therewith an air gap, the lever arm being attracted to said armature bridge on energizing of the coil; and a leaf spring connecting the lever arm to the second portion of the L-shaped lever so that the lever arm can pivot relative to the L-shaped lever.

5. Matrix printhead, having a case including a plurality of print styli drives, there being a plurality of print styli extending in said case and from the respective drives therein, towards a mouthpiece at an end of the case, to be positioned adjacent a printing platen, the head provided for movement along the platen; said mouthpiece being movable within said case and in a direction that extends transverse to an extension of the styli; a print styli mouthpiece adjusting device in said case, including an electromagnetic drive, the drive including a coil/core arrangement including a coil and a core having an axis around which the coil loops, the axis extending transversely to said direction of movement of the head, said adjusting device further including actuation lever means with an armature means for cooperation with the coil/core arrangement and being connected to said mouthpiece for moving the position of the mouthpiece in a direction transverse to the direction of movement of said matrix printhead and to the extension of said axis of said drive; the improvement comprising:

the actuation lever means having a first, front arm carrying said mouthpiece, and a second, lever arm secured to one end of the core of the coil/core arrangement and being arranged in magnetic conductive relation therewith;

a leaf spring pivotably connecting the front arm to the second lever arm to obtain said moving of the mouthpiece; and an armature bridge, movably and adjustably fastened to the case for adjustment in a direction of said mouthpiece moving which is transversely to the axis of the core, and being held in magnetic conductive abutment with an opposite end of the core to establish an adjustable magnetic gap between the bridge as conductively connected to the core and the front arm, the core remaining invariant to the adjustment by the bridge.

* * * * *